US010280766B2

(12) United States Patent
Deighton et al.

(10) Patent No.: US 10,280,766 B2
(45) Date of Patent: May 7, 2019

(54) BLADED ROTOR FOR A GAS TURBINE ENGINE

(71) Applicant: ROLLS-ROYCE plc, London (GB)

(72) Inventors: Andrew J Deighton, Derby (GB); Pierre-Antoine J Sis, Derby (GB); Peter A Evans, Derby (GB)

(73) Assignee: ROLLS-ROYCE plc, London (GB)

( * ) Notice: Subject to any disclaimer, the term of this patent is extended or adjusted under 35 U.S.C. 154(b) by 382 days.

(21) Appl. No.: 15/138,650

(22) Filed: Apr. 26, 2016

(65) Prior Publication Data

US 2016/0333708 A1 Nov. 17, 2016

(30) Foreign Application Priority Data

May 12, 2015 (GB) ..... 1508040.1

(51) Int. Cl.
*F01D 5/30* (2006.01)

(52) U.S. Cl.
CPC ..... *F01D 5/3015* (2013.01); *F05D 2250/71* (2013.01)

(58) Field of Classification Search
CPC ..... F01D 5/3015
See application file for complete search history.

(56) References Cited

U.S. PATENT DOCUMENTS

2007/0258816 A1* 11/2007 Bouchard ..... F01D 11/006 416/193 A
2010/0254807 A1* 10/2010 Smoke ..... F01D 5/08 415/174.2
2012/0034087 A1* 2/2012 Dungs ..... F01D 5/3015 416/219 R (Continued)

FOREIGN PATENT DOCUMENTS

EP 2 357 321 A2 8/2011
EP 2354451 A2 8/2011

(Continued)

OTHER PUBLICATIONS

Nov. 11, 2015 Search Report issued in British Patent Applicaton No. 1508040.1.

(Continued)

*Primary Examiner* — Woody A Lee, Jr.
(74) *Attorney, Agent, or Firm* — Oliff PLC

(57) ABSTRACT

A bladed rotor includes rotor disc having a peripheral region, and a plurality of rotor blades attached to and extending radially outwardly from peripheral region. Each rotor blade has a root portion which is located in a correspondingly shaped axially-extending slot provided in the peripheral region of rotor disc, and the root portion of each blade is axially retained in its respective slot by a plate located axially adjacent the root portion and rotor disc, and which extends circumferentially across respective slot. Retention plate is held in position by seal member having a first surface which engages radially-inwardly directed surface of rotor disc, and second surface which is located radially-outwardly of first surface and engages the retention plate. Seal member has a curved profile in radial cross-section so as to define a concavity located radially between first and second engaging surfaces and which is directed axially towards the rotor disc.

18 Claims, 4 Drawing Sheets

(56) References Cited

U.S. PATENT DOCUMENTS

| | | | | |
|---|---|---|---|---|
| 2016/0090854 | A1* | 3/2016 | Webb | F01D 5/081<br>416/220 R |
| 2016/0222787 | A1* | 8/2016 | Beattie | F01D 5/081 |
| 2016/0222809 | A1* | 8/2016 | Hough | F01D 11/006 |
| 2017/0204732 | A1* | 7/2017 | Hoell | F01D 5/3015 |

FOREIGN PATENT DOCUMENTS

| | | | |
|---|---|---|---|
| EP | 2540979 | A2 | 1/2013 |
| EP | 3 002 410 | A1 | 4/2016 |
| EP | 3 002 411 | A1 | 4/2016 |
| GB | 2 435 909 | A | 9/2007 |
| WO | 2015/038605 | A1 | 3/2015 |
| WO | 2015/073112 | A2 | 5/2015 |

OTHER PUBLICATIONS

Jul. 13, 2016 Search Report issued in British Patent Application No. 1607194.6.

Aug. 8, 2018 Office Action issued in Great Britain Application No. GB1607194.6.

* cited by examiner

BLADED ROTOR FOR A GAS TURBINE ENGINE

The present invention relates to a bladed rotor for a gas turbine engine, and is particularly concerned with the fixing of aerofoil blades on such a rotor.

Gas turbine engines commonly include an axial flow turbine comprising a plurality of axially spaced-apart bladed rotors. Each of the rotors comprises a disc carrying an annular array of radially outwardly extending aerofoil blades around its periphery. Each aerofoil blade is provided with a root at is radially inner end, which locates in an appropriately shaped axially extending slot formed in the disc periphery. The root may conveniently have a form known in the art as a "fir tree" configuration. The root of each blade is slid axially into its location slot so that the fir tree configuration of the root and its correspondingly shaped slot provide radial retention of the blade.

It is necessary to provide some means for axially retaining each aerofoil blade in its disc slot. One way of achieving this is to provide an annular array of retention plates which extend across the ends of the blade roots and the adjacent axial surface of the disc. Such plates are generally effective in preventing axial movement of the blade roots within their respective slots, and also in preventing air leakage between the blade roots and their location slots. However it is important to hold the retention plates in position and in sealing engagement with the blade roots and the adjacent axial surface of the disc, in order to prevent the leakage of air from the location slots into the space axially downstream of the disc. Airflow through the location slots is usually used to cool the peripheral region of the rotor disc and the roots of the blades, so such leakage in this manner is disadvantageous. This is normally achieved by the provision of one or more seal members which engage a radially inwardly directed spigot formed on the disc, and extend radially outwardly therefrom so as also to engage the radially innermost edge region of one or more of the retention plates. A seal member of this type will typically be arranged to bear against an axially directed surface of the retention plate in order to urge it into close engagement with the blade roots and the rotor disc.

However, it has been found that conventional seal members of the general type described above can be subject to problematic thermal contraction when the gas turbine engine is decelerating. It has been found that under such conditions the radially outermost region of the seal member cools down more quickly than its radially innermost region, which can give rise to a significant thermal gradient radially across the seal member. This causes the radially outermost region of the seal member to contract, which can cause it to become deformed so as to move axially away from the rotor disc and the retention plates, thereby opening up a gap between the retention plates and the seal member through which air can leak from the location slots. As will be appreciated, this can be problematic because such leakage reduces the flow of air which can be used to cool the peripheral region of the rotor disc and the root portions of the blades.

It is therefore an object of the present invention to provide an improved bladed rotor for a gas turbine engine.

According to a first aspect of the present invention, there is provided a bladed rotor for a gas turbine engine, the rotor comprising: a rotor disc having a peripheral region, and a plurality of rotor blades attached to and extending radially outwardly from said peripheral region, each rotor blade having a root portion which is located in a correspondingly shaped generally axially extending slot provided in the peripheral region of the rotor disc; the root portion of each blade being axially retained in its respective slot by a retention plate located axially adjacent the root portion and the rotor disc, and which extends circumferentially across said respective slot; said retention plate being held in position by a seal member, the seal member having a first engaging surface which engages a radially inwardly directed surface of the rotor disc, and a second engaging surface which is located radially outwardly of the first engaging surface and engages the retention plate, wherein the seal member has a curved profile in radial cross-section so as to define a concavity located radially between said first and second engaging surfaces and which is directed axially towards the rotor disc.

Preferably, said curved profile of the seal member is configured such that said concavity extends axially past said retention plate.

Advantageously, said concavity has a radius of curvature which is at least 0.4 times the radial spacing between said first and second engaging surfaces of the seal member.

Conveniently, said concavity has a radius of curvature of at least 8 mm.

Optionally, said radius of curvature is centred in axial alignment with said first engaging surface of the seal member.

Preferably, said seal member includes a wall which is configured in radial cross-section so as to extend axially and radially outwardly from said first engaging surface, and then to curve back towards said rotor disc so as to extend axially and radially outwardly towards said second engaging surface.

Advantageously, said wall is of substantially uniform thickness.

Conveniently, said second engaging surface of the seal member is configured to bear against an axially directed surface of the retention plate.

Optionally, said second engaging surface of the seal member is configured to bear against a radially inner edge region of the retention plate.

The bladed rotor may comprise a plurality of said retention plates arranged circumferentially adjacent one another in an annular array, wherein each retention plate is arranged to extend circumferentially across at least one of said slots to thereby axially retain a respective blade in the or each said slot.

Optionally, the bladed rotor may comprise a plurality of said seal members arranged circumferentially adjacent one another in an annular array, each said seal member being arranged to hold at least one said retention plate in position.

Alternatively, the bladed rotor may have a single said seal member of annular configuration.

Preferably, said seal member is formed of a nickel-based superalloy material.

The bladed rotor may be provided in the form of a turbine rotor for a gas turbine engine, but can alternatively be provided in the form of a compressor rotor.

According to a second aspect of the present invention, there is provided a gas turbine engine comprising a bladed rotor according to the first aspect.

So that the invention may be more readily understood, and so that further features thereof may be appreciated, embodiments of the invention will now be described by way of example with reference to the accompanying drawings in which.

Figure 1:
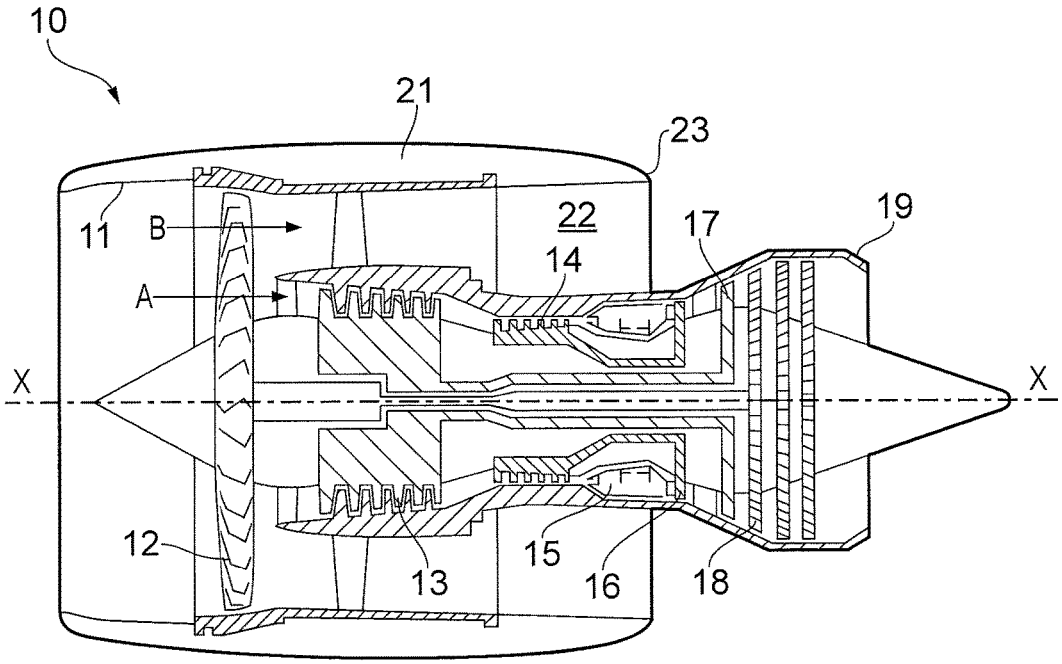
FIG. 1 is a schematic longitudinal cross-sectional view of a ducted fan gas turbine engine of a type which may include a bladed rotor in accordance with the present invention.

With reference to FIG. 1, a ducted fan gas turbine engine of a type which may incorporate the invention is generally indicated at 10 and has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, an intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

During operation, air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

Whilst it is envisaged that the bladed rotor of the present invention will be particularly suitable for use in the high pressure turbine 16, and will therefore be described in further detail below with particular reference to such an arrangement, it is to be appreciated that the present invention could alternatively be embodied in the intermediate or low pressure turbines 17, 18, or even in one or both of the compressors 13, 14.

Figure 2:
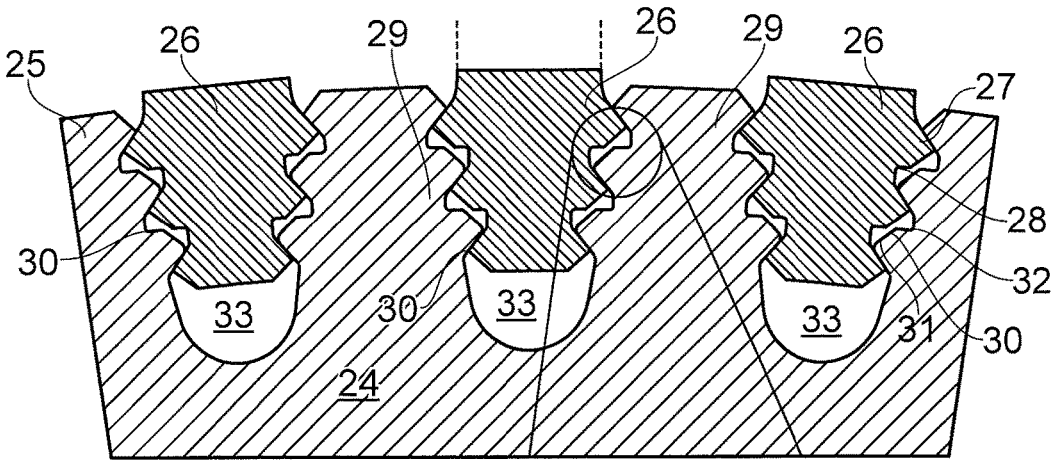
FIG. 2 is a schematic rear axial view of part of a rotor disc, showing the roots of three rotor blades mounted to the disc.

FIG. 2 shows schematically a rear view of a part of a disc 24 for turbine of the gas turbine engine 10, such as the above-mentioned high pressure turbine 16. A row of circumferentially spaced turbine blades is mounted to a peripheral region 25 of the disc 24, the roots 26 of three of the blades being shown in FIG. 1. Each root 26 is formed as a fir tree, tapering inwardly in width with increasing inwardly radial distance between circumferentially spaced sides, and with a series of fore-to-aft extending projections 27 and grooves 28 formed by the sides. The disc 24 has circumferentially spaced, radially extending posts 29 formed around its peripheral region 25 between which are formed axially extending locating slots 30 of corresponding fir-tree shaped radial cross-section. The sides of the slots thus also form a series of fore-to-aft extending projections 31 and grooves 32.

To mount the blades to the disc 24, the roots 26 slide into the slots 30 in the (axial) direction of extension of the projections 27, 31 and grooves 28, 32, with the projections 27 on the sides of the roots 26 fitting into the grooves 32 on the sides of the locating slots 30, and the projections 31 on the sides of the slots 30 fitting into the grooves 28 on the sides of the roots 26. The fir-tree configuration of the blade roots 26 and the locating slots 30 thus serves to radially retain the roots 26 in position around the disc 24.

As will be noted, the particular arrangement illustrated in FIG. 2 is configured such that the projections 27, 31 on the roots 26 and inside the slots 30 are somewhat truncated such that they do not completely fill the respective grooves 32, 28 into which they are fitted. This type of arrangement thus permits the flow of cooling air, which may be bled from a compressor section of the engine 10, between the roots 26 and the slots 30 in order to improve the cooling of these areas. However, it is to be appreciated that in other arrangements, the projections 27, 31 arising from the fir tree configuration of the roots 26 and the slots 30 may not be truncated in this manner, and so may instead more fully fill the grooves 32, 28 into which they fit. In both cases, the roots 26 and slots 30 have complimentary shapes for tight interengagement.

Furthermore, it is to be noted that the present invention is not even to be limited to arrangements comprising fir tree shaped roots 26 and locating slots 32. For example, in other embodiments it is envisaged that the roots 26 and locating slots 32 could be of a simpler dovetail configuration in radial cross-section, devoid of the projections 27, 31 and grooves 28, 32 described above. It is envisaged that this type of configuration may be particularly suitable for compressor rotors.

Returning now to consider the arrangement illustrated in FIG. 2, it will be noted that spaces 33 are formed between the bases of the roots 26 and the bottoms of the locating slots 30. These spaces 33 are provided to receive cooling air which is bled from the engine's compressor. This cooling air enters internal passages (not shown) in the roots 26 and is conveyed radially outwardly to cool the aerofoil sections of the blades.

Figure 3:
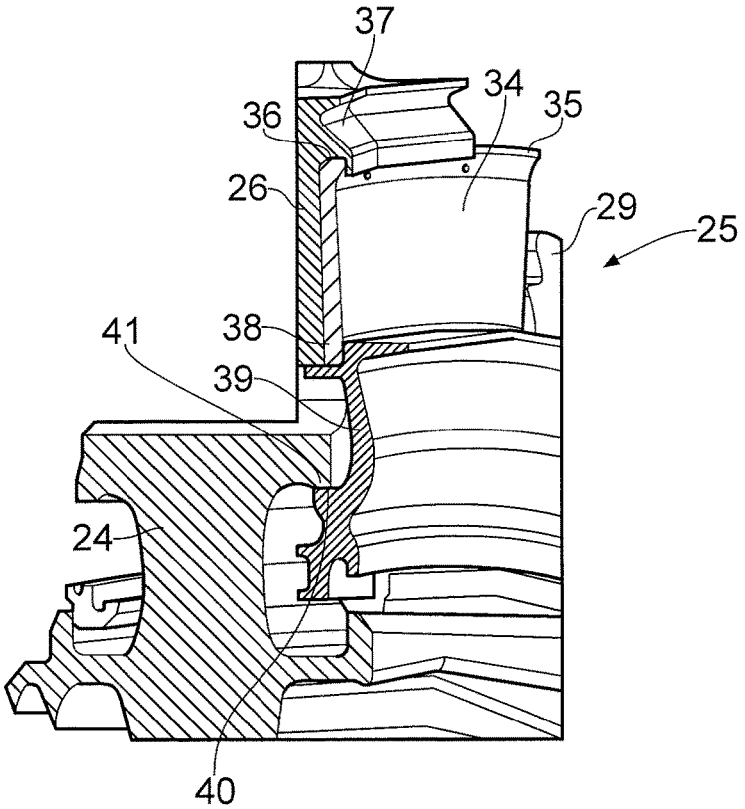
FIG. 3 is a perspective view showing part of the disc in combination with a lock plate and a seal plate which are used in combination to hold the blade roots in place.

As shown most clearly in the perspective view of FIG. 3, the roots 26 of the blades are retained axially within their respective locating slots 30 by one or more retention plates 34 located axially adjacent the roots 26 and the rotor disc 24 on the forward and/or rearward side of the disc. FIG. 3 shows a single retention plate 34 in an arrangement which will have a plurality of such plates arranged circumferentially adjacent one another in an annular array around the disc 24 in order to axially retain all of the blade roots 26 in their respective locating slots 30. As illustrated, each retention plate 34 is arranged to extend circumferentially across at least one of the locating slots 30 and will thus serve to prevent axial movement of the respective blade root 26 out of the or each said slot 30.

The outer peripheral edge 35 of the retention plate 34 engages one or more radially inwardly directed grooves 36 formed in respective blade platforms 37. The inner peripheral edge region 38 of the retention plate 34 is engaged by a seal member 39 which will be described in more detail below, but which is provided to function in concert with the grooves 36 in the blade platforms 37 to hold the retention plate 34 in axial position relative to the blade roots 26 and adjacent regions of the disc 24, and in particularly in substantially sealing engagement therewith to prevent leakage of cooling air from the spaces 33 at the bottom of the locating slots 30.

Figure 4:
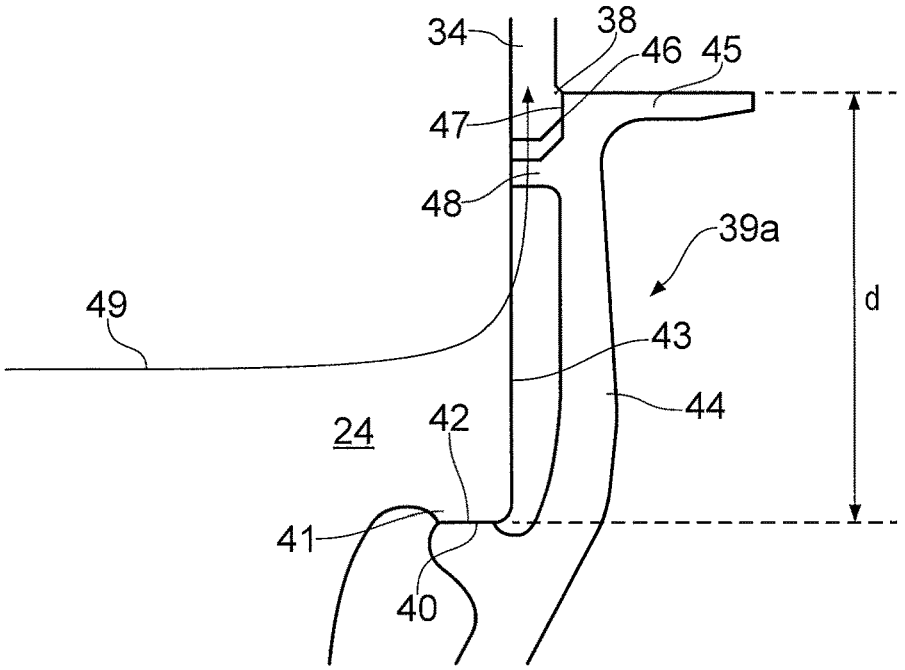
FIG. 4 is a schematic radial cross-sectional view showing a conventional lock plate in more detail.

FIG. 4 illustrates, in radial cross-section, the conventional form of seal member 39*a* in more detail, several aspects of which are shared with the seal member of the present invention, which will be described in more detail below. As will be noted, the conventional seal member 39*a* has an engaging surface 40 which bears against a small spigot 41 which projects radially inwardly from the main part of the disc 24 and which presents a radially inwardly directed surface 42 which is generally adjacent the axial side face 43 of the disc. The engaging surface 40 of the seal member thus engages the radially inwardly directed surface 42 of the disc 24. The seal member 39*a* also comprises a wall portion 44 which extends generally radially outwardly from the engaging surface 40, in axially spaced relation to the side face 43 of the disc, towards the retention plate 34. The wall portion 44 terminates in an axially directed rim 45 which presents a second engaging surface 46 for engagement with the axially directed surface 47 of the retention plate 34, along its radially inner edge region 38.

The seal member 39*a* is thus configured to bear against the radially inner edge region 38 of the retention plate 34, thereby urging and holding the retention plate 35 in close abutting engagement with the blade root 26 and the adjacent regions of the disc 24. As illustrated, the seal member 39*a* may also have a small axially extending lip 48 which abuts the side face 43 of the disc 24 radially inwardly of the retention plate 34.

The seal member 39*a* has a radial dimension d, measured between its first engaging surface 40 and the radially outermost edge of its second engaging surface 46. In typical disc arrangements configured to form part of an engine's high pressure turbine 16, this radial dimension may be of the order of 20 mm for a seal member having an overall outer diameter of approximately 310 mm.

As will be appreciated, when the seal member 39*a* is properly located as illustrated in FIG. 4, it effectively seals against the retention plate 34, whilst also holding the retention plate 34 in substantially sealing engagement against the blade roots 26 and adjacent regions of the disc 24. The seal member 39*a* thus prevents the leakage of cooling air, as denoted by arrow 49 in FIG. 4, from the spaces 33 at the bottom of the location slots 30, thereby ensuring that none of the cooling air is diverted from its primary role in cooling the rotor blades.

Figure 5:
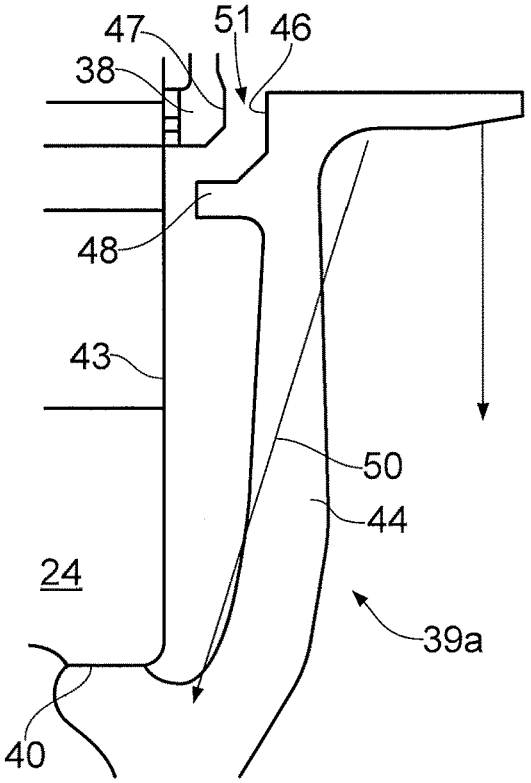
FIG. 5 is a view corresponding generally to that of FIG. 4, but which shows the lock plate in a deflected configuration, which can arise due to a thermal gradient under certain operational conditions.

However, as indicated above, during deceleration of the engine, and hence also the turbine rotor, the radially outermost region of the seal member 39*a* will cool down more rapidly than the radially inner part, which gives rise to a significant thermal gradient generally radially across the seal member 39*a* as denoted schematically by arrow 50 in FIG. 5. It has been found that in the case of a high pressure turbine rotor 16 for some gas turbine engines, this thermal gradient can be in excess of 100 K. The thermal gradient creates a contraction of the radially outer region of the seal member 39*a*, which has been observed to cause the wall portion 44 to deform in a manner in which it moves away from the disc 24. As will be appreciated from FIG. 5, this also causes the seal member's second engaging surface 46 to move away from the retention plate 35, creating a gap 51 therebetween which has been observed to be in the range of 1.0 to 5.5 mm wide, and also causes the lip 48 to move away from the side surface 43 of the disc 24. In this condition the seal member 39*a* is no longer effective in urging the retention plate 35 into sealing engagement with the blade roots 26 and the disc 24, or indeed in sealing against the side face 43 of the disc itself via the lip 48. In this deformed condition, the seal member 39*a* can thus permit leakage of the cooling air from the spaces 33 at the bottom of the blade location slots 30, which as indicated above is disadvantageous.

Figure 6:
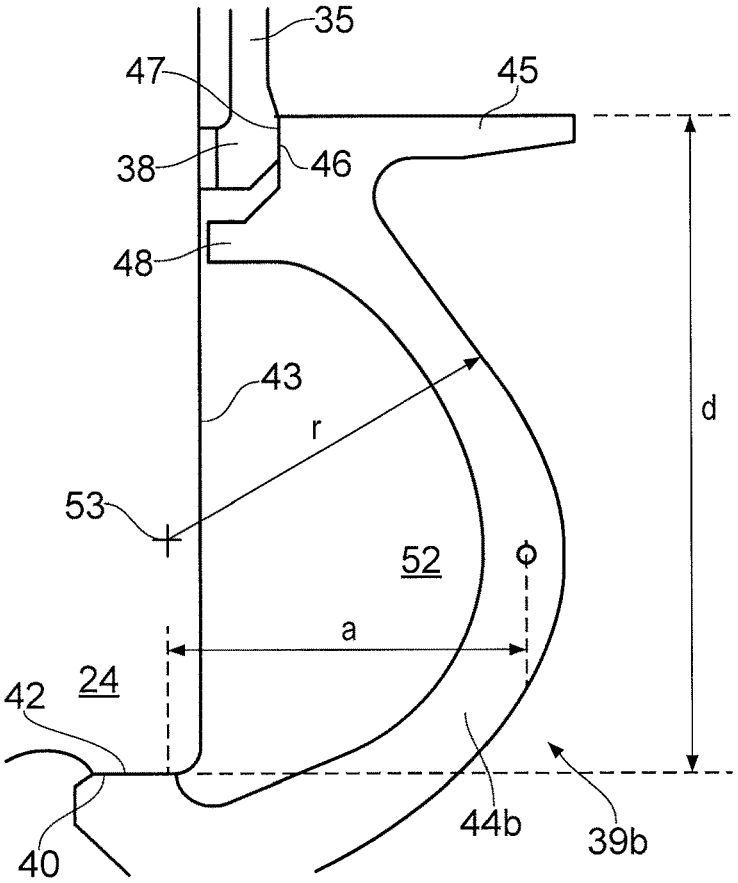
FIG. 6 is a schematic radial cross-sectional view showing a lock plate in accordance with an embodiment of the present invention.

Turning now to consider FIG. 6, there is illustrated a modified form of seal member 39*b* which forms part of the present invention, and which has been found to mitigate the above-mentioned problems with conventional seal members. As will be noted, the modified seal member 39*b* shares several features with the above-described seal member 39*a*, which are thus identified by the same reference numbers and will not be described again in detail.

As clearly illustrated in FIG. 6, the wall portion 44*b* of the seal member 39*b*, which has substantially uniform thickness, is steeply curved in radial cross-section and is configured such that it extends axially and radially outwardly from the first engaging surface 40, and significantly axially beyond the retention plate 35, before then curving back towards the rotor disc 24 so as to extend axially and radially outwardly towards the seal member's second engaging surface 46. The seal member 39*b* thus has a curved profile in radial cross-section and is configured to define a concavity 52, inside the curve of the wall 44*b*, which is located radially between the seal member's first and second engaging surfaces 40, 46, and which is directed axially towards the rotor disc 24. As will be noted, the concavity 52 extends axially beyond the retention plate 35.

The curved profile of the seal member 39*a* can take various forms. However the currently proposed arrangement illustrated in FIG. 6 is configured such that the radius of curvature r of the curved wall 44*b* is approximately 0.4 times the radial spacing d between the first and second engaging surfaces 40, 46. In the case of a seal member 39*b* configured to fit the same disc 24 and retention plate 35 arrangement as described above with reference to FIG. 4, the seal member 39*b* will be configured to have a radial spacing of approximately 20 mm between the two engaging surfaces 40, 46, which would make its radius of curvature r approximately 8 mm. As will be noted, the radius of curvature r is centred on a point 53 which is substantially axially aligned with the first engaging surface 40, and is thus located slightly behind the side face 43 of the disc 24.

Figure 7:
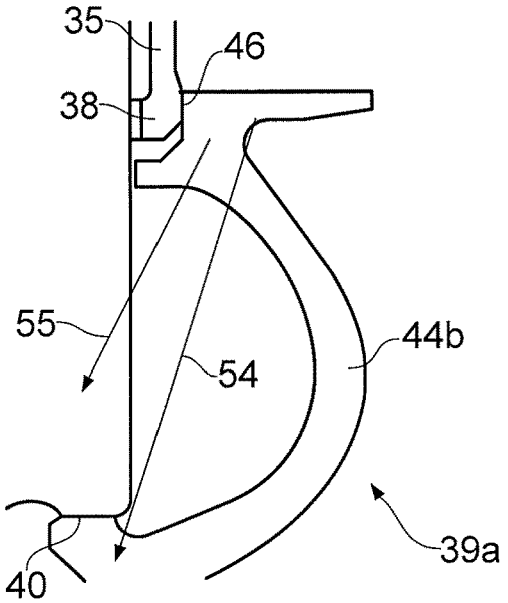
FIG. 7 is a view corresponding generally to that of FIG. 6, showing the lock plate under similar thermal conditions to those shown in FIG. 5.

The above-described curved profile of the seal member 39*b* means that it performs in a significantly different manner to conventional seal members 39*a* in the event of a thermal gradient being established during engine deceleration. Of course, as in the case of conventional seal members 39*a*, the radially outermost region of the modified seal member 39*b* will still cool more rapidly than its radially innermost region during engine deceleration, and so as similar thermal gradient will be established radially across the seal member, as denoted by arrow 54 in FIG. 7. However, the curved configuration of the wall 44*b* means that the resulting contraction (denoted by arrow 55 in FIG. 7) of the radially outermost region of the seal member 39*b* will have an axial component towards the rotor disc 24. This means that the seal member 39*b* will contract upon engine deceleration in such a way that its second seal surface 46 is actually urged more firmly against the inner edge region 38 of the retention plate, thereby preventing a gap from opening up between the seal member 39*b* and the retention plate 35, and thereby preventing the leakage of cooling air from the location slots 30 in which the blade roots 26 are engaged.

It has been found that the above-described performance of the seal member 39*b* can be further improved by increasing its radius of curvature r. It is therefore proposed that suitable arrangements may be configured such that the radius of curvature r is at least 0.4 times the radial spacing d between said first and second engaging surfaces 40, 46 of the seal member 39*b*. It has also been found that the radial position of the point of maximum axial spacing a between the side face 43 of the disc 24 and the curved wall 44 of the seal member does not have a major influence on the performance of the seal member 39*b*, as long as the axial spacing a is kept sufficiently large.

It is proposed that the seal member 39*b* will be formed from a suitable nickel-based superalloy material.

It is to be noted that it is within the scope of the present invention to provide either a single seal member 39*b* of annular configuration which extends circumferentially all of the way around the disc, or alternatively to provide a plurality of discrete seal members 39*b* arranged circumferentially adjacent one another in an annular array such that each seal member 39*b* will axially hold at least one retention plate 35 in position.

When used in this specification and claims, the terms "comprises" and "comprising" and variations thereof mean that the specified features, steps or integers are included. The terms are not to be interpreted to exclude the presence of other features, steps or integers.

The features disclosed in the foregoing description, or in the following claims, or in the accompanying drawings, expressed in their specific forms or in terms of a means for performing the disclosed function, or a method or process for obtaining the disclosed results, as appropriate, may, separately, or in any combination of such features, be utilised for realising the invention in diverse forms thereof.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A bladed rotor for a gas turbine engine, the rotor comprising: a rotor disc having a peripheral region, and a plurality of rotor blades attached to and extending radially outwardly from said peripheral region, each rotor blade having a root portion which is located in a correspondingly shaped generally axially extending slot provided in the peripheral region of the rotor disc; the root portion of each blade being axially retained in its respective slot by a retention plate located axially adjacent the root portion and the rotor disc, and which extends circumferentially across said respective slot; said retention plate being held in position by a seal member, the seal member having a first engaging surface which engages a radially inwardly directed surface of the rotor disc, and a second engaging surface which is located radially outwardly of the first engaging surface and engages the retention plate, wherein the seal member has a curved profile in radial cross-section that includes a curved wall surface with a radius of curvature (r) that is at least 0.4 times the radial spacing (d) between said first and second engaging surfaces of the seal member, the curved profile defining a concavity located radially between said first and second engaging surfaces and which is directed axially towards the rotor disc.

2. A bladed rotor according to claim 1, wherein said curved profile of the seal member is configured such that said concavity extends axially past said retention plate.

3. A bladed rotor according to claim 1, wherein said concavity has a radius of curvature (r) of at least 8 mm.

4. A bladed rotor according to claim 1, wherein said radius of curvature (r) is centred in axial alignment with said first engaging surface of the seal member.

5. A bladed rotor according to claim 1, wherein the retention plate comprises a plurality of retention plates arranged circumferentially adjacent one another in an annular array, wherein each retention plate is arranged to extend circumferentially across said respective slot to thereby axially retain a respective blade in said respective slot.

6. A bladed rotor according to claim 1, wherein said seal member includes a wall which is configured in radial cross-section so as to extend axially and radially outwardly from said first engaging surface, and then to curve back towards said rotor disc so as to extend axially and radially outwardly towards said second engaging surface.

7. A bladed rotor according to claim 6, wherein said wall is of substantially uniform thickness.

8. A bladed rotor according to claim 1, wherein said second engaging surface of the seal member is configured to bear against an axially directed surface of the retention plate.

9. A bladed rotor according to claim 1, wherein said second engaging surface of the seal member is configured to bear against a radially inner edge region of the retention plate.

10. A bladed rotor according to claim 5, wherein the seal member is a seal member of annular configuration that extends circumferentially all the way around the rotor disc and is arranged to hold said plurality of retention plates in position.

11. A bladed rotor according to claim 1, wherein the seal member comprises a plurality of seal members arranged circumferentially adjacent one another in an annular array, each said seal member being arranged to hold at least one said retention plate in position.

12. A bladed rotor according to claim 1, wherein said seal member is formed of a nickel-based superalloy material.

13. A bladed rotor according to claim 1 provided in the form of a turbine rotor for a gas turbine engine.

14. A gas turbine engine comprising a bladed rotor according to claim 1.

15. A bladed rotor for a gas turbine engine, the rotor comprising: a rotor disc having a peripheral region, and a plurality of rotor blades attached to and extending radially outwardly from said peripheral region, each rotor blade having a root portion which is located in a correspondingly shaped generally axially extending slot provided in the peripheral region of the rotor disc; the root portion of each blade being axially retained in its respective slot by a retention plate located axially adjacent the root portion and the rotor disc, and which extends circumferentially across said respective slot; said retention plate being held in position by a seal member, the seal member having a first engaging surface which engages a radially inwardly directed surface of the rotor disc, and a second engaging surface which is located radially outwardly of the first engaging surface and engages the retention plate, wherein the seal member has a curved profile in radial cross-section including a continuously curved wall surface that defines a concavity located radially between said first and second engaging surfaces and which is directed axially towards the rotor disc; wherein said concavity has a radius of curvature (r) and wherein said radius of curvature (r) is centred in axial alignment with said first engaging surface of the seal member.

16. A bladed rotor for a gas turbine engine according to claim 15, wherein said concavity has a radius of curvature (r) of at least 8 mm.

17. A bladed rotor according to claim 15, wherein said second engaging surface of the seal member is configured to bear against an axially directed surface of the retention plate.

18. A bladed rotor according to claim 15, wherein said second engaging surface of the seal member is configured to bear against a radially inner edge region of the retention plate.

* * * * *